US012753927B2

(12) United States Patent
Schmickal et al.

(10) Patent No.: US 12,753,927 B2
(45) Date of Patent: Oct. 6, 2026

(54) METHOD, COMPUTER PROGRAM AND CONTROL DEVICE FOR CONTROLLING A COOKING APPLIANCE AND COOKING APPLIANCE SYSTEM

(71) Applicant: Wilhelm BRUCKBAUER, Neubeuern (DE)

(72) Inventors: Julian Schmickal, Niederndorf (AT); Michael Jungmann, Niederndorf (AT); Hannes Kepplinger, Niederndorf (AT); Julia Tüchler, Niederndorf (AT); Kay Schuster, Niederndorf (AT)

(73) Assignee: Werkhaus GmbH & Co. KG (DE)

( * ) Notice: Subject to any disclaimer, the term of this patent is extended or adjusted under 35 U.S.C. 154(b) by 323 days.

(21) Appl. No.: 18/034,917

(22) PCT Filed: Oct. 22, 2021

(86) PCT No.: PCT/EP2021/079379
§ 371 (c)(1),
(2) Date: May 2, 2023

(87) PCT Pub. No.: WO2022/096290
PCT Pub. Date: May 12, 2022

(65) Prior Publication Data

US 2023/0400188 A1 Dec. 14, 2023

(30) Foreign Application Priority Data

Nov. 3, 2020 (DE) ..... 10 2020 213 804.4

(51) Int. Cl.
*F24C 7/08* (2006.01)

(52) U.S. Cl.
CPC ..... *F24C 7/085* (2013.01)

(58) Field of Classification Search
None
See application file for complete search history.

(56) References Cited

U.S. PATENT DOCUMENTS

| | | | | |
|---|---|---|---|---|
| 9,860,362 | B2 | 1/2018 | Kuemmerle et al. | |
| 2002/0094778 | A1 | 7/2002 | Cannon et al. | |
| 2004/0080415 | A1* | 4/2004 | Sorensen | G08B 13/2491 340/568.1 |
| 2011/0114620 | A1* | 5/2011 | Lommel | F24C 7/082 219/209 |
| 2015/0319730 | A1* | 11/2015 | Seine | H04W 64/003 370/338 |

(Continued)

FOREIGN PATENT DOCUMENTS

| | | | |
|---|---|---|---|
| DE | 102014215778 | A1 | 2/2016 |
| DE | 102016206912 | A1 | 10/2017 |

(Continued)

OTHER PUBLICATIONS

Extended European Search Report for European Application No. 23160223.6, mailed May 19, 2023, 8 Pages.

(Continued)

*Primary Examiner* — Ariel Mercado-Vargas
(74) *Attorney, Agent, or Firm* — POLSINELLI PC

(57) ABSTRACT

A method for controlling a cooking appliance of the basis of a control command transferred from a mobile device to a control device via a wireless data connection, comprising the steps of: capturing a plurality of the sample values correlating to a signal strength of the wireless data connection, determining a test value on the basis of the plurality of sample values, comparing the test value with a reference test value to determine a comparison result, limiting the controllability of said cooking appliance by means of the mobile device according to the comparison result.

8 Claims, 5 Drawing Sheets

(56) References Cited

U.S. PATENT DOCUMENTS

| | | | | |
|---|---|---|---|---|
| 2016/0301543 | A1* | 10/2016 | Minezawa | G06F 3/0482 |
| 2017/0309146 | A1* | 10/2017 | Mackenzie | G08B 13/2491 |
| 2017/0310810 | A1* | 10/2017 | Kuemmerle | F24C 7/08 |
| 2018/0128493 | A1* | 5/2018 | Chen | F24C 7/083 |
| 2018/0330603 | A1* | 11/2018 | Langhammer | F24C 7/08 |
| 2019/0162418 | A1* | 5/2019 | Egenter | F24C 15/105 |
| 2019/0374060 | A1* | 12/2019 | Winterrose | A23L 5/13 |
| 2020/0359836 | A1* | 11/2020 | Schulz | A47J 36/32 |

FOREIGN PATENT DOCUMENTS

| | | | |
|---|---|---|---|
| DE | 102020213804 | A1 | 5/2022 |
| EP | 3236709 | A1 | 10/2017 |
| JP | 2009109039 | A | 5/2009 |
| JP | 2015033069 | A | 2/2025 |
| KR | 1020170121078 | A | 11/2017 |
| WO | 2015172881 | A1 | 11/2015 |

OTHER PUBLICATIONS

International Preliminary Report on Patentability for International Application No. PCT/EP2021/079379, mailed May 19, 2023, 15 Pages.

International Search Report and Written Opinion for International Application No. PCT/EP2021/079379, mailed Jan. 27, 2022, 18 Pages.

Korean Patent Application No. 10-2023-7018452, mailed Nov. 21, 2025, 15 Pages.

* cited by examiner

METHOD, COMPUTER PROGRAM AND CONTROL DEVICE FOR CONTROLLING A COOKING APPLIANCE AND COOKING APPLIANCE SYSTEM

CROSS-REFERENCES TO RELATED APPLICATIONS

This application claims the priority of German Patent Application, Serial No. DE 10 2020 213 804.4, filed Nov. 3, 2020, the content of which is incorporated herein by reference in its entirety as if fully set forth herein.

FIELD OF THE INVENTION

The invention relates to a method for controlling a cooking appliance. The invention further relates to a computer program for a control device for controlling a cooking appliance. The invention also relates to such a control device and to a cooking appliance system comprising such a control device.

BACKGROUND OF THE INVENTION

A method for controlling a cooking appliance by means of a mobile terminal separate from the cooking appliance is known from EP 3 236 709 A1. Operating commands from the mobile terminal are blocked when the signal strength of a wireless communication link between the mobile terminal and the cooking appliance is low. If the signal strength subsequently increases again, the operating commands remain blocked. The disadvantage is that this method for remote control of a cooking appliance by means of a mobile terminal is susceptible to interference and thus not very user-friendly.

SUMMARY OF THE INVENTION

It is therefore an object of the invention to provide an improved method for controlling a cooking appliance, which in particular ensures particularly robust, reliable and safe control of a cooking appliance by means of a mobile device.

This object is achieved by a method for controlling a cooking appliance, on the basis of a control command transferred from a mobile device to a control device via a wireless data connection, comprising the steps of capturing a plurality of sample values correlating to a signal strength of the wireless data connection, determining a test value on the basis of the plurality of sample values, comparing the test value with a reference test value to determine a comparison result, and limiting the controllability of the cooking appliance by means of the mobile appliance according to the comparison result. It has been recognized that the control of the cooking appliance on the basis of a control command transferred from the mobile device to the control device via a wireless data connection can be carried out in a particularly robust, reliable and safe manner if the controllability of the cooking appliance by means of the mobile device is limited on the basis of a plurality of sample values which correlate to a signal strength of the wireless data connection. In particular, limiting the controllability of the cooking appliance by means of the mobile device can be performed depending on a comparison result determined by comparing a test value with a reference test value. Preferably, the test value is determined on the basis of the plurality of sample values. Transferring the control command may comprise transmitting the control command, in particular by means of the mobile device, and/or receiving the control command, in particular by means of the control device. Controlling the cooking appliance by means of the mobile device is particularly convenient for the user. Preferably, the mobile device and/or the control device for controlling the cooking appliance are first provided, in particular at the cooking appliance. Subsequently, the wireless data connection between the control device and the mobile device can be established. The mobile device is preferably portable and may be carried with the user. The mobile device may have a power source, in particular a battery or an accumulator. Control commands thus do not have to be entered by the user directly at the control device, in particular at the cooking appliance, but can be flexibly issued via the freely positionable mobile device. Due to the fact that the limitation of the controllability is carried out on the basis of a plurality of sample values correlating to the signal strength makes the method particularly robust against disturbing influences, in particular against fluctuations in the signal strength and measurement errors. In particular, it can be avoided that a one-time deviating, faulty sample value leads to the restriction of the controllability of the cooking appliance by means of the mobile device, in particular including subsequent blocking of operating commands of the mobile device.

The signal strength of the wireless data connection depends in particular on a distance between the mobile device and the control device. The limitation of the controllability takes place depending on the signal strength and thus also on the distance between the mobile device and the control device. The method thus ensures that the control of the cooking appliance by means of the mobile device can be prevented at a distance between these devices at which the cooking appliance is outside an area that is controllable by the user. Preferably, the control of the cooking appliance is prevented from an area outside the user's viewable area. This allows the cooking appliance to be controlled in a particularly safe manner.

The control device is preferably a component of the cooking appliance. Preferably, the control device is designed to control at least one consumer, in particular a heating unit and/or a fan, in particular an extractor fan. The heating unit of the cooking appliance is preferably arranged at a distance from the control device which is in a range from 0 m to 1 m, in particular from 0 m to 0.5 m, in particular from 0.05 m to 0.25 m. The control device is preferably arranged at a support structure of the cooking appliance and/or in a housing of the cooking appliance.

The control device may include a control communication module for forming the wireless data connection between the control device and the mobile device. The wireless data connection may be based on the transmission of data by means of electromagnetic radiation, in particular UV radiation and/or radio waves, in particular a radio frequency and/or a Bluetooth frequency and/or a WiFi frequency and/or a Zigbee frequency. The control communication module can accordingly be designed as a UV module and/or as a Bluetooth module, in particular as a BLE module (Bluetooth Low Energy), and/or as a WiFi module. A mobile communication module of the mobile device for forming the wireless data connection between the control device and the mobile device is preferably designed for communication with the control communication module.

The control device can be designed as a separate module, in particular arranged at the cooking appliance in a non-destructively detachable manner, and/or have its own power supply and/or have exclusively reversibly detachable data interfaces, in particular for wired data transmission, and/or have its own housing. Alternatively, the control device can be integrated into the cooking appliance, in particular be arranged at least partially, in particular completely, on a circuit board of the cooking appliance, and/or have a common power supply with the cooking appliance and/or have a non-destructively detachable, wired data interface to the cooking appliance.

The control device preferably comprises a control user interface for exchanging information with the user. The control user interface may comprise an input unit, in particular a switch and/or a button and/or a touch-sensitive sensor, in particular a touch-sensitive screen, and/or a microphone, and/or an output unit, in particular a lamp and/or a screen and/or a loudspeaker.

According to one aspect of the invention, the cooking appliance comprises a basic control device for controlling the at least one consumer. Preferably, the basic control device is configured for exclusively wired signal transmission, in particular without a radio module. It may have a control user interface for exchanging information with the user. Preferably, the basic control device is designed to control, in particular all functions, of the cooking appliance, in particular independently of control commands from the control device and/or a connection to the control device. In this case, the control device may not be absolutely necessary for operating the cooking appliance. In particular, the control device can be an optional component of the cooking appliance system and/or can be retrofitted. Advantageously, this means that the control device can be used to subsequently expand the functional scope of the cooking appliance with regard to control by means of a mobile device via a wireless data connection.

The basic control device is connected to the control device, in particular the control communication module, preferably in a signal-transmitting manner, in particular by cable or wirelessly. The basic control device can be designed separately from the control device, in particular arranged in a separate housing. The basic control device and the control device can be connected to each other for the exchange of control information and/or status information. The basic control device can be connected to the at least one mobile device via the control device in a signal-transmitting manner. Preferably, the cooking appliance can be controlled by means of the basic control device on the basis of control commands from the control device and/or the at least one mobile device.

Preferably, the basic control device and/or the control device are in signal connection with a sensor of the cooking appliance system, in particular a temperature sensor, in particular a meat thermometer, and/or a pressure sensor. The sensor can be connected to the basic control device and/or the control device wirelessly or via a cable connection in a signal-transmitting manner. The control of the cooking appliance by means of the basic control device and/or the control device can take place on the basis of a signal provided by the sensor.

According to a further aspect of the invention, controlling the cooking appliance by means of at least one mobile device is carried out without capturing the sample values correlating to the signal strength of the wireless data connection, in particular without limiting the controllability by means of this at least one mobile device depending on the comparison result. For example, in the case of mobile devices which are used, for example, to control functions of the cooking appliance which are not critical for the operational safety, a correspondingly complex capturing and processing of the signal strength can be dispensed with. Such mobile devices are preferably connected to the control device via a WiFi connection.

The capturing of the sample values, the determination of the test value, the comparison of the test value with the reference test value and/or the limitation of the controllability in dependence on the comparison result preferably take place at predetermined time intervals and/or during the entire period of existence of the wireless data connection. For this purpose, the sample values can be determined in a sampling interval of a maximum of 10 s, in particular of a maximum of 5 s, in particular of a maximum 2 s, in particular of a maximum of 1 s, in particular of a maximum of 0.5 s, in particular of a maximum of 0.1 s, and/or at least 0.001 s, in particular at least 0.1 s, in particular at least 1 s. The test value is preferably determined in each case following the acquisition of a predetermined number of sample values, in particular at least two sample values, in particular at least three sample values, and/or a maximum of ten sample values. The comparison of the test value with the reference test value preferably is performed in each case following the determination of the test value. The limitation of the controllability in dependence on the comparison result preferably takes place in each case after the determination of the respective comparison result.

Limiting the controllability of the cooking appliance by means of the mobile device can also be done under the condition that the signal quality falls below a reference signal quality. The signal quality can be determined, for example, by transmitting test data between the control device and the mobile device.

The mobile device can be a mobile phone, in particular a smartphone, a tablet PC, a laptop, a cooking product sensor and/or a mobile operating device associated with the cooking appliance. The mobile operating device associated with the cooking appliance is preferably understood to mean a mobile device distributed by the manufacturer of the cooking appliance and/or a mobile device that is preconfigured for a connection to the cooking appliance, in particular by the manufacturer, and/or a mobile device identifiable as associated with the cooking appliance, in particular by means of an identification means. The identification means can have unique identification information, in particular stored in digital form, in particular in digital and/or analogous form, for marking the affiliation to the cooking appliance. With regard to limiting the controllability of the cooking appliance by means of the mobile device in dependence on the comparison result, a more generous standard, in particular a higher threshold value, in particular a higher reference test value, may be specified for the operating device belonging to the cooking appliance than for a mobile device not belonging to the cooking appliance. The mobile device is preferably portable. For this purpose, it may have a weight of a maximum of 50 N, in particular of a maximum of 30 N, in particular of a maximum of 10 N. The operating device can have a mobile user interface for exchanging information with the user. The operating user interface preferably comprises an input unit, in particular a switch and/or a button and/or a touch-sensitive sensor, in particular a touch-sensitive screen and/or a microphone, and/or an output unit, in particular a lamp and/or a screen and/or a loudspeaker.

The cooking appliance can be, for example, a hob and/or a hob system including at least one hob and an extractor fan apparatus and/or an oven, in particular a steam oven, and/or a warming drawer and/or a sous-vide appliance. Preferably, the cooking appliance is a hob system and the at least one mobile device is a mobile operating device associated with the cooking appliance and/or a cooking product sensor and/or a smartphone.

The scope of controllability of the cooking appliance by means of the mobile device may include controlling a heating unit, in particular a heating unit of the hob and/or the oven and/or the warming drawer. The control by means of the mobile device may be manual by an input of the user via the mobile user interface and/or automated, in particular by a control algorithm of the mobile device. The automated control can be carried out, for example, on the basis of a cooking recipe. The control algorithm can be designed to process the cooking recipe in this case.

To establish the wireless data connection between the control device and the mobile device, a unique, one-time device identifier is preferably transmitted from the mobile device to the control device. For the initial connection of the mobile device with the control device, a confirmation of the user at the control device, in particular via the control user interface, may be required. This reliably ensures that the establishment of the wireless data connection requires an input at the control device, in particular at the cooking appliance, itself at least once. The method is thus particularly secure against manipulation attempts. The device identifier can be stored in the control device, in particular in a control memory unit of the control device, and used as a test key for re-establishing the wireless data connection with the mobile device.

A dynamic key, i.e. a data key that changes over time, can be used to establish and/or maintain the wireless data connection. Preferably, the dynamic key is exchanged using an encryption algorithm after predetermined time intervals. This makes the wireless data connection even more secure.

Determining the sample values correlating to the signal strength of the wireless data connection can be performed by means of the control device and/or by means of the mobile device. In particular, the respective communication module can be designed to detect the sample value in the form of the signal strength and/or a measured value correlating to the signal strength. The sample value can be captured as an absolute value of a received power, in particular with logarithmic scaling, in particular in decibels, and/or as a relative value in relation to a maximum received power and/or as a corresponding voltage value, in particular between 0 V and 5 V, and/or as a corresponding digital signal. The respective sample value preferably correlates to, in particular preferably corresponds to, an RSSI value (received signal strength indicator) and/or a ToF value (time-of-flight) detected in particular by the respective communication module, in particular if the respective communication module is designed as a Bluetooth module, in particular as a BLE module. Preferably, the test value correlates to the RSSI value and/or the ToF value.

The reference test value can be a variable, in particular manually and/or automatically variable, and/or a predetermined, non-variable value. The reference test value preferably correlates to, in particular preferably corresponds to, a specific signal strength, in particular in a range from 0% to 90%, in particular from 1% to 80%, in particular from 20% to 75%, in particular from 30% to 70%, of a maximum signal strength. Preferably, the reference test value correlates to a distance between the control device and the mobile device in a range from 0 m to 20 m, in particular from 1 m to 15 m, in particular from 2.5 m to 10 m, in particular from 4 m to 8 m.

Limiting the controllability of the cooking appliance by means of the mobile device can comprise a reduction of the scope of control options, in particular a complete prevention of controllability or no complete prevention of controllability. Preferably, the limited controllability prevents the control of at least individual, in particular all, heating units of the cooking appliance. Control of, for example, the extractor fan apparatus of the hob system can still be possible even with limited controllability. To restrict controllability, control commands from the mobile device can be ignored or blocked. Alternatively, the wireless data connection may be interrupted. Preferably, the user is informed about the restricted controllability, in particular via a corresponding information output at the control user interface and/or at the mobile user interface. Control inputs at the mobile user interface can be prevented, in particular by preventing corresponding inputs, in particular by blocking and/or no longer displaying input fields. The control device preferably transmits a signal to the mobile device via the wireless data connection with information about the extent to which the cooking appliance can be controlled by means of the mobile device, in particular whether the controllability is restricted.

The scope of controllability of the cooking appliance by means of the mobile device may include switching on and/or switching off the cooking appliance. Limiting controllability may include preventing the cooking appliance from being switched on by the mobile device. Preferably, the cooking appliance, in particular the heating unit, is switched off due to the restriction of controllability. Alternatively, the cooking appliance, in particular the at least one heating unit, can continue to be operated according to the last control command received before the limitation of controllability.

Preferably, the cooking appliance is also controllable via the control user interface. The scope of control options via the control user interface of the control device can be greater than or equal to the scope of control options via the mobile device. Preferably, control commands via the control user interface are given priority over control commands from the mobile device.

According to one aspect of the invention, limiting the controllability of the cooking appliance by means of the mobile device is performed under the condition that the test value is lower than the reference test value. Thus, limiting the signal strength is preferably performed when the signal strength is too low and/or the distance between the cooking appliance and the mobile device is too great.

According to one aspect of the invention, the test value is determined using at least two, in particular at least three, in particular at least five and/or a maximum of one hundred, in particular a maximum of ten, of the sample values. The control of the cooking appliance by means of the mobile device can thus be performed in a particularly robust and reliable manner. The controllability of the cooking appliance by means of the mobile device is thus particularly robust with respect to measurement errors and signal disturbances that lead to a brief drop in the signal strength.

According to one aspect of the invention, a scatter value of the plurality of sample values from which the test value is identified is determined. The scatter value preferably correlates to, in particular preferably corresponds to, the difference between a maximum value and a minimum value of the plurality of sample values and/or a standard deviation of the plurality of sample values. The scatter value is a measure of the stability of the signal strength. Preferably, the limitation of the controllability is performed taking into account the scatter value.

According to one aspect of the invention, profile information of the mobile device is stored, in particular on the control device and/or on the mobile device. The profile information is preferably collected by means of the control device and/or the mobile device. The profile information may comprise a unique identifier, a communication address, in particular an MAC address, hardware information, in particular relating to the communication module and/or an installed computer chip, in particular a mobile processor, and/or sensors, in particular a compass, software information, in particular relating to the operating system installed on the mobile device, communication information, for example a digital key, a correction value, in particular for determining a distance between the mobile device and the control device on the basis of the at least one sample value and/or the test value, a date and/or a time of the, in particular initial, establishment of the data connection.

Depending on the profile information, the wireless data connection can be established. It can be determined whether a reference test value and/or a calibration test value must be determined, whether the mobile device is suitable for controlling the cooking appliance and/or what proportion of available functions of the cooking appliance, in particular functions that can be controlled to a maximum via the wireless data connection, can be controlled by means of the connected mobile device. In particular, the profile information can be used to determine how the test value is determined using the plurality of sample values and/or to what extent the controllability of the cooking appliance by means of the mobile device is limited in dependence on the comparison result.

The profile information is preferably stored for each mobile device that has entered the wireless data connection with the control device at least once.

The profile information can be provided at least in part by the mobile device and/or transmitted via the wireless data connection. The collection and/or storage of the communication information can be triggered automatically, in particular by the initial establishment of the wireless data connection between the control device and the mobile device.

The test value and/or the reference test value preferably correlate to a distance between the mobile device and the control device. In particular, the test value and/or the reference test value can each be determined and/or provided as a distance, in particular in metres. The test value can correspond to the instantaneous distance between the mobile device and the control device. The reference test value can be specified as a distance threshold value which, if exceeded, in particular by the test value, limits the controllability of the cooking appliance by means of the mobile device.

Preferably, the distance between the mobile device and the control device is determined using an exponential function and/or a correction value z. The base of the exponential function may comprise, in particular consist of, the Euler number e and/or the number 10. The exponent may comprise, in particular consist of, the at least one sample value. Preferably, the exponent comprises an average value y of a plurality of the sample values. According to a particular, in particular independent, aspect of the invention, the average value of the plurality of sample values is constituted by the Levelled Average RSSI value. The exponent may further comprise at least one of the variables v1, v2. The variables v1, v2 and/or the correction value z may be determined on the basis of the profile information, in particular on the basis of the type of communication module and/or the operating system present on the mobile device and/or in the course of a calibration step. The variable v1 is preferably in the range from 10 to 100, in particular in the range from 20 to 80, in particular in the range from 30 to 50, in particular in the range from 40 to 45, in particular in the range from 42 to 43. The variable v2 is preferably in the range from 0 to −50, in particular in the range from −5 to −25, in particular in the range from −10 to −15, in particular in the range from −12 to −13. The distance D is preferably determined as the sum of the exponential function and the correction value z. Preferably, the determination of the distance D between the mobile device and the control device is carried out as follows:

$$D = e^{\left(\frac{y+v1}{v2}\right)} + z.$$

The correction value z can be determined, for example, in dependence on an operating system installed on the mobile device, in particular in dependence on whether an IOS operating system or in Android operating system is installed on the mobile device. The correction value z is preferably in the range from −10 to +10, in particular from −5 to +5, in particular from −3.5 to +3.5, in particular from −2 to +2. The correction value z can be selected to be equal to 0 or not equal to 0. Accordingly, a correction value can be dispensed with. The correction value z can be chosen individually for the respective mobile device by determining the plurality of sample values.

Capturing the sample values and/or determining the test value and/or comparing the test value with the reference test value are preferably performed continuously, in particular during the existence of the wireless signal connection, in particular at regular time intervals, in particular at a frequency of at least 0.1 Hz, in particular at least 1 Hz, in particular at least 5 Hz, and/or at a maximum of 100 Hz, in particular at a maximum of 10 Hz, in particular at a maximum of 1 Hz.

According to one aspect of the invention, limiting the controllability of the cooking appliance by means of the mobile device may be performed in dependence on the comparison result and at least one further comparison result. The first comparison result may be determined by comparing the RSSI value to an RSSI threshold value. The RSSI threshold value preferably falls within a range from −10 to −200, in particular within a range from −50 to −100, in particular within a range from −65 to −80. If the RSSI value falls below the RSSI threshold value, the controllability of the cooking appliance by means of the mobile device can be limited.

A second comparison result can be determined by comparing a distance between the mobile device and the control device with a distance threshold. The distance threshold preferably falls within the range of 1 m to 25 m, in particular within the range of 2 m to 15 m, in particular within the range of 3 m to 10 m, in particular it is 5 m. If the distance threshold value is exceeded, the controllability of the cooking appliance by means of the mobile device can be restricted. By limiting the controllability of the cooking appliance on the basis of at least two comparison results that are based on different values, the cooking appliance can be controlled in a particularly reliable and safe manner.

According to one aspect of the invention, limiting the controllability of the cooking appliance by means of the mobile device is performed under the condition that the scatter value is lower than a reference scatter value. The reference scatter value may be an absolute value, in particular in a range from 5 dB to 50 dB, in particular from 10 dB to 20 dB, and/or a relative value, in particular in a range from 5% to 50%, in particular from 10% to 30%, of the test value and/or the reference test value.

Limiting the controllability can also occur when the scatter value exceeds a reference scatter value. Thus, limiting the controllability can take place when the scatter value is high due to poor signal quality.

According to one aspect of the invention, the test value is discarded as a function of the scatter value, in particular if the scatter value exceeds the reference scatter value. This is understood to mean that the test value is disregarded for determining the controllability of the cooking appliance by means of the mobile device and/or for determining the comparison result.

According to one aspect of the invention, determining the test value comprises determining a sample average value of the plurality of sample values. Determining the test value may also comprise determining the rate of change of the sample values over time. In particular, the scatter value may be taken into account when determining the test value. This allows the control of the cooking appliance to be particularly robust and reliable.

According to one aspect of the invention, the plurality of sample values are captured over a measurement duration in a range from 0.1 s to 10 s, in particular from 0.5 s to 5 s, in particular from 1 s to 3 s, to determine the test value. This reduces the influence of short-term disturbances of the wireless data connection, in particular on the comparison result. The control of the cooking appliance can thus be particularly robust and reliable.

According to one aspect of the invention, a calibration test value is determined as a test value at a preset distance between the control device and the mobile device. The calibration test value is preferably determined on the basis of at least one test value, in particular on the basis of a plurality of test values, and/or on the basis of a plurality of sample values, in particular on the basis of at least five, in particular at least ten, in particular at least 50, in particular at least 100, and/or a maximum of 1000, in particular a maximum of 500, sample values. The preset distance can be, in particular absolutely or in the horizontal direction, a maximum of 50 m, in particular a maximum of 10 m, in particular a maximum of 5 m, in particular a maximum of 2 m, in particular 0 m, and/or at least 1 m, in particular at least 2 m, in particular at least 5 m, in particular at least 10 m. The calibration test value preferably correlates to, in particular preferably corresponds to, the signal strength of the wireless data connection at the preset distance. Preferably, the preset distance corresponds to the distance beyond which the limitation of controllability is to occur. Preferably, for determining the calibration test value, the user is prompted by means of the control user interface and/or the mobile user interface to position the mobile device at the preset distance from the control device and/or the cooking appliance and/or to confirm this arrangement via the respective user interface. The calibration test value is preferably determined after confirming the arrangement at the predetermined distance. In this manner, the signal strength of the wireless data connection, in particular with a previously unknown mobile device, can be used to infer the distance between the control device and the mobile device. The method is thus particularly robust, reliable and safe to execute.

The determination of the calibration test value is preferably carried out under the condition that the scatter value is lower than the reference scatter value and/or that the signal quality is higher than a reference signal quality.

According to one aspect of the invention, the reference test value is determined using the test value. Manual entry of the reference test value can thus be avoided. In addition, the individual transmission power of the mobile device can be taken into account. Preferably, an individual reference test value is assigned to each individual mobile device, in particular to the respective unique device identifier. The reference test value, in particular the combination of the reference test value and the device identifier, can be stored in the control memory unit and/or a mobile memory unit of the mobile device. The method is thus particularly safe to execute and user-friendly.

According to another aspect of the invention, the reference test value is determined on the basis of the at least one, in particular on the basis of at least two, in particular on the basis of at least three, and/or on the basis of a maximum of five calibration test values. This makes it possible to limit the controllability of the cooking appliance by means of the mobile device particularly precisely in dependence on the distance between these devices. Taking into account the plurality of calibration test values enables a particularly precise determination of the distance between the control device and the mobile device. To determine the plurality of reference test values, the user is preferably prompted to arrange the mobile device at different distances from the control device, in accordance with the method described above, and to confirm this arrangement in each case. This allows influences on the signal strength to be taken into account which are caused by local conditions, such as furniture, building elements, electrical devices and/or interfering signals. The reference test value thus correlates particularly precisely to the desired distance from which the limitation of controllability is to take place. The method is thus particularly robust, reliable and safe to execute.

According to a further aspect of the invention, the determination of the calibration test value and/or the reference test value is automatically triggered, in particular by, in particular directly following, the initial establishment of the wireless data connection between the control device and the mobile device. The determination of the reference test value can also be performed repeatedly, in particular on the basis of a manual user input and/or after an interruption of the power supply to the control device and/or after a software update of the control device and/or the mobile device.

According to a further aspect of the invention, the determination of the reference test value can be performed manually by a user input. The user can thus determine the reference test value according to his/her individual requirements. Preferably, a change is only possible within a certain range, in particular a maximum of 50%, in particular a maximum of 20%, of a preset or previously determined reference test value. This makes the method particularly safe.

According to another aspect of the invention, extending the controllability of the cooking appliance by means of the mobile device is performed in dependence on the comparison result. Extending the controllability may be performed to the original, in particular full, control scope. Extending the controllability is preferably only carried out under at least one of the additional conditions that the user confirms this at the control user interface and/or that the wireless data connection has not been completely interrupted for the duration of the limited controllability. Such a method ensures a particularly high level of user comfort.

According to a further aspect of the invention, extending the controllability of the cooking appliance by means of the mobile device takes place in dependence on a switching period over which the controllability was restricted. The switching period is preferably measured from the time at which the controllability of the cooking appliance by means of the mobile device is restricted and/or over the period of time over which the controllability of the cooking appliance by means of the mobile device is restricted without continuously, i.e. uninterruptedly. Preferably, extending the controllability takes place under the condition that the switching period over which the controllability was limited is a maximum of 60 s, in particular a maximum of 30 s, in particular a maximum of 10 s. If this switching period is exceeded, extending the controllability can preferably only take place under the additional condition that a confirmation by the user takes place at the control device, in particular the control user interface. Advantageously, this prevents a mobile device that is reconnected to the control device after a longer period of time, in particular after hours, from leading to an activation of the cooking appliance that is unnoticed by the user.

According to another aspect of the invention, a visual and/or acoustic and/or a haptic warning signal is emitted, in particular at the cooking appliance and/or the control device, in particular the control user interface, and/or the mobile device, in particular the mobile user interface, in dependence on the comparison result. The warning signal may be output, for example, when the test value approaches the reference test value, in particular when the test value exceeds the reference test value in a range from 0% to 30% of the reference test value, in particular from 5% to 20% of the reference test value. The warning signal can be output via the respective user interface of the cooking appliance and/or the mobile device, for example via the screen and/or the loudspeaker and/or a vibration generator, in particular a vibration motor. The method ensures a particularly high level of user comfort, as the user is warned against inadvertently causing a limitation of controllability.

According to a further aspect of the invention, information is output on a display unit of the mobile device in dependence on the comparison result. Via the wireless data connection, information, in particular status information about the cooking appliance, in particular control information and/or performance information and/or sensor information, in particular of a temperature sensor and/or a humidity sensor and/or a filter sensor and/or information about the cooking product, in particular information about the composition and/or the adhesive quality of the cooking product, can generally be transmitted to the mobile device. This information can be displayed on the mobile user interface, in particular the screen. The status information may also be transmitted and/or displayed at the mobile device during the limited controllability via the wireless data connection. The output of information that is dependent on the comparison result may comprise the indication of the limited controllability and/or the display or hiding of input options, in particular input masks, and/or the display or hiding of control icons. Controlling the cooking appliance by means of the mobile device can thus take place especially intuitively.

Another object of the invention is to provide an improved computer program for a control device for controlling a cooking appliance.

This object is achieved by a computer program, in particular for a mobile device and/or for a control device for controlling a cooking appliance, which is designed to execute a method according to the above description. The computer program is preferably stored on at least one control memory unit of the control device and/or on at least one mobile memory unit of the mobile device. The computer program can also be stored on a single or on a plurality of separate storage units, in particular on a USB stick, and/or stored on an online data memory.

According to one aspect of the invention, the computer program stored, in particular on the mobile device and/or on the control device, can be overwritten, in particular updated. For example, the mobile device and/or the control device may be configured to perform an update of the computer program by means of a local storage medium, in particular a USB stick, and/or from an online data source, in particular via the Internet, in particular via a Wi-Fi connection. In particular, the computer program can be overwritten with regard to the stored reference test value and/or the reference scatter value and/or the specified distance, in particular in the course of a software update.

A further object of the invention is to provide an improved control device for controlling a cooking appliance.

This object is achieved by a control device for controlling a cooking appliance, comprising a control processor unit for processing data, and at least one control memory unit which is in signal connection with the control processor unit and has a computer program stored thereon in accordance with the above description. The computer program can be stored on a single control memory unit or distributed over a plurality of control memory units of the control device and/or mobile memory units of the mobile device, in particular exclusively of the control device. The control device preferably comprises a control communication module that is in signal connection with the control processor unit for wirelessly transferring data, in particular control information. The control communication module is preferably a radio module, in particular a Bluetooth module, in particular a BLE module. Preferably, the radio module is designed for transferring data over a distance of a maximum of 50 m, in particular a maximum of 20 m, in particular a maximum of 10 m, and/or at least 2 m, in particular at least 5 m. This allows the distance between the cooking appliance and the mobile device to be determined particularly precisely on the basis of the signal strength. The control communication module is preferably also designed for the wired transfer of data, in particular of control and/or status information. For this purpose, the control communication module can have a serial interface and/or a bus interface, in particular for connecting to different and/or a plurality of cooking appliances and/or to the basic control device. The control device can be designed as a separate, in particular retrofittable, module.

Yet another object of the invention is to provide an improved cooking appliance system.

This object is achieved by a cooking appliance system comprising at least one cooking appliance for heating food to be cooked, and a control device that is in signal connection with the at least one cooking appliance for controlling the cooking appliance according to the above description. The cooking appliance preferably comprises at least one heating unit for heating food to be cooked, in particular a hob including at least one hot plate and/or an oven, in particular a steam oven, and/or a warming drawer.

Further advantages, features and details of the invention will be apparent from the following description of an embodiment example based on the figures.

DESCRIPTION OF THE PREFERRED EMBODIMENT

Figure 1:
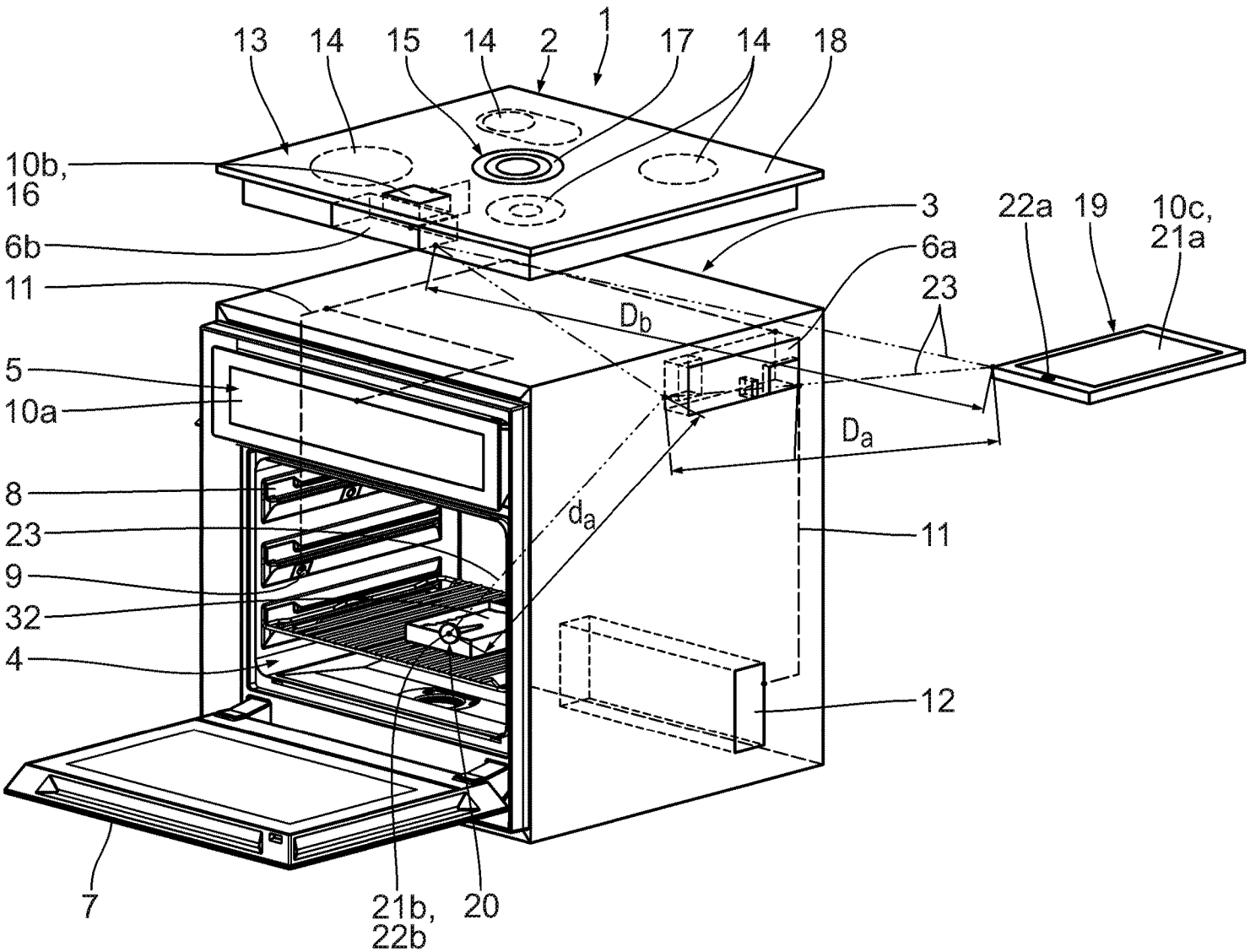
FIG. 1 shows a perspective illustration of a cooking appliance system having two control devices for controlling one cooking appliance each connected thereto for heating food to be cooked by means of two mobile devices that are wirelessly connected to the control devices.

With regard to FIG. 1 to FIG. 5 an embodiment example of a cooking appliance system 1 is described. The cooking appliance system 1 has a first cooking appliance in the form of a hob system 2 and a second cooking appliance in the form of an oven 3.

The oven 3 comprises a cooking chamber 4 into which cooking products can be placed for heating, an oven user interface 5 for exchanging information with the user, in particular for inputting and outputting information, and a control device 6*a* for controlling the oven 3. The cooking chamber 4 can be reversibly closed by means of a cooking chamber door 7. A cooking chamber sensor 9 is arranged on a cooking chamber wall 8 to detect the temperature and humidity in the cooking chamber 4.

The oven user interface 5 comprises a touch-sensitive screen 10*a*, in particular with a capacitive foil sensor for touch recognition and an OLED display. A heating unit 12 of the oven 3 is designed to heat the air inside the cooking chamber 4. The control device 6*a* is in signal-transmitting connection with the oven user interface 5, the cooking chamber sensor 9 and the heating unit 12 via a cable connection 11.

The hob system 2 has a hob 13 with four hot plates 14, an extractor fan apparatus 15 and a hob user interface 16. The extractor fan apparatus 15 comprises an inflow opening 17 which penetrates a cooking product carrier 18, in particular in a top view in a central region of the cooking product carrier 18. The extractor fan apparatus 15 is designed to extract cooking vapours downwards. A fan, which is not shown, is designed to draw cooking vapours downwards through the inlet opening 17 from a region above the cooking product carrier 18.

The cooking product carrier 18 may include a glass ceramic plate. The hob user interface 16 is arranged in a top view in the region of the cooking product carrier 18. The hob user interface 16 comprises a display unit 10*b* with control symbols, in particular illuminated by LEDs. The display unit 10*b* is overlapped, in particular the control symbols are each overlapped, by a touch-sensitive sensor, not shown, for the input of user commands.

The hob system 2 comprises a control device 6*b* for controlling the hob system 2, in particular the hob 13 with the hot plates 14 and the extractor fan apparatus 15. The control device 6*b* of the hob system 2 may have the features of the control device 6*a* of the oven 3. The control devices 6*a*, 6*b* are preferably designed to be identical.

The cooking appliance system 1 includes a first mobile device in the form of a mobile phone 19 and a second mobile device in the form of a cooking appliance sensor 20. The mobile phone 19 comprises a mobile user interface 21*a* for exchanging information with the user. The mobile user interface 21*a* comprises a touch-sensitive screen 10*c* and a button 22*a*. The cooking product sensor 20 includes a mobile user interface 21*b* with a button 22*b*.

The mobile phone 19 is connected to the control devices 6*a*, 6*b* via a wireless data connection 23 in a signal-transmitting manner. The cooking product sensor 20 is connected to the control device 6*a* via a wireless data connection 23 in a signal-transmitting manner.

The control device 6*b* comprises a control processor unit 24 for data processing, a control memory unit 25 for storing data and a control communication unit 26 for transferring data. The control communication unit 26 is designed for data exchange via the cable connection 11, in particular with the hob user interface 16. Furthermore, the control communication unit 26 is designed for exchanging data via the wireless data connection 23, in particular with the mobile phone 19 and/or with a cooking product sensor 20 and/or with a mobile operating device that is associated with the cooking appliance 2. For wireless transfer of data, the control communication unit 26 has a control radio module 27. The control radio module 27 is a Bluetooth module, in particular a BLE module.

The mobile phone 19 includes the mobile user interface 21*a*, a mobile processor unit 28 for data processing, a mobile memory unit 29 for storing data and a mobile communication unit 30 for transferring data, in particular for the wired and/or wireless transfer of data. A mobile radio module 31 of the mobile communication unit 30 is designed for the wireless transfer of data, in particular via the wireless data connection 23.

A computer program is stored on the control memory unit 25, which is designed to execute the method described below.

The operating principle of the cooking appliance system 1 with the control devices 6*a*, 6*b*, in particular with regard to their interaction with the mobile devices 19, 20, for controlling the cooking appliances 2, 3 is as follows:

The hob system 2 and the oven 3 are provided on a kitchen base cabinet not shown. The hob system 2 is inserted into a hob recess of a kitchen worktop not shown. The oven 3 is built into the kitchen base cabinet.

The mobile devices 19, 20 are provided at the cooking appliance system 1. The mobile phone 19 is arranged at a distance $D_a$ from the control device 6*a* of the oven 3 and at a distance $D_b$ from the control device 6*b* of the hob system 2. The cooking product sensor 20 is arranged at a distance $d_a$ from the control device 6*a* of the oven 3. In particular, the cooking product sensor 20 is arranged in the cooking chamber for detecting the temperature of a cooking product 32. In detail, the respective distance $D_a$, $D_b$, $d_a$ refers to the distance between the respective radio modules 27, 31.

Figure 2:
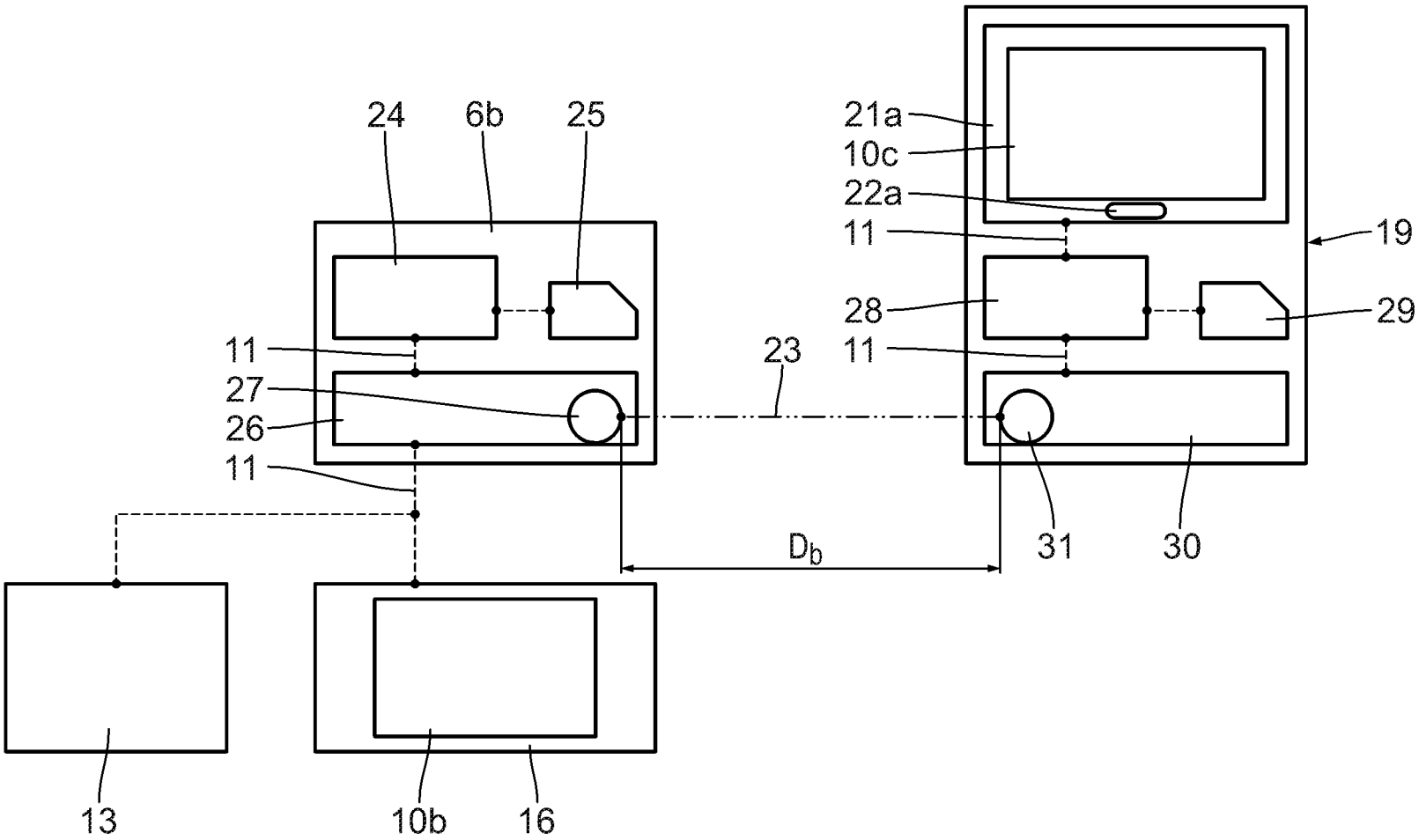
FIG. 2 shows an abstracted illustration of one of the control devices and the wirelessly connected mobile device in FIG. 1.

With reference to FIG. 2, the control device 6*b* of the hob system 2 and the mobile phone 19 are described in further detail. The following aspects concerning the interaction of the control device 6*b* and the mobile phone 19 also apply to the interaction of the control device 6*a* with the mobile phone 19 and with the cooking product sensor 20.

The hob system 2 and the mobile phone 19 are switched on. In particular, the control radio module 27 and the mobile radio module 31 are activated. Activation of the respective radio module 27, 31 can take place, for example, via a user input at the hob user interface 16 or the mobile user interface 21*a*.

A connection is established between the control radio module 27 and the mobile radio module 31. Controlling the hob system 2 using the mobile phone 19 is not yet possible during this limited data connection. Confirmation by the user at the hob user interface 16 is required to enable the wireless data connection 23 to control the hob system 2 using the mobile phone 19. This release is linked to a unique, in particular one-time, device identifier of the mobile phone 19. This ensures that the control of the hob system 2 via the wireless data connection 23 requires confirmation of the user at the hob system 2 at least once. In this case, the authorisation is only granted for a specific, uniquely identifiable mobile device 19, 20. This procedure prevents unauthorised mobile devices from gaining wireless, i.e. remote, access to control functions of the cooking appliance 2, 3.

Preferably, a further prerequisite for authorising the mobile device 19, 20 to control the cooking appliance 2, 3 via the wireless connection 23 is that a dynamic key, for example in the form of a digital code, is transmitted, in particular at specific time intervals, from the mobile device 19, 20 to the control device 6*a*, 6*b* via the wireless data connection 23. This dynamic key is characterized by the fact that it is automatically changed after a certain period of time has elapsed. This can further increase the security of the control of the cooking appliances 2, 3 via the wireless data connection 23 against manipulation attempts.

The wireless data connection 23 between the mobile phone 19 and the control device 6*b* of the hob system 2 is established. The mobile phone 19 can be used to control the hob system 2.

The screen 10*c* of the mobile user interface 21*a* displays control icons corresponding to the controllable components of the hob system 2, namely the hot plates 14 and the extractor fan apparatus 15. A user input on the touch-sensitive screen 10*c* can be used to adjust the power of the hot plates 14 and the extractor fan apparatus 15. The data corresponding to such a control command is processed by the mobile processor unit 28 and transmitted to the control device 6*b* by means of the mobile communication unit 30, in particular by means of the mobile radio module 31, via the wireless data connection 23. The control device 6*b* receives the control data by means of the control communication unit 26, in particular by means of the control radio module 27, processes the control data by means of the control processor unit 24 and provides a signal for controlling the hot plates 14 and/or the extractor fan apparatus 15 via the respective cable connection 11.

Information about the current performance of the hot plates 14 and/or the extractor fan apparatus 15 is collected by the control device 6*b* and transmitted to the mobile phone 19 via the wireless data connection 23. This data is displayed to the user via the screen 10*c*.

The scope of the control options of the mobile phone 19 with respect to the hob system 2 thus comprises the control of the hot plates 14 and the control of the extractor fan apparatus 15. Status information on the hob system 2, which the mobile phone 19 receives from the control device 6*b* via the wireless data connection 23, comprises performance values of the hot plates 14 and of the extractor fan apparatus 15 and preferably also sensor data, in particular on temperatures of the hot plates 14 and/or a humidity in the extractor fan apparatus 15 and/or a filter capacity of a filter of the extractor fan apparatus 15 and/or downtimes and/or running times of the hot plates 14 and/or of the extractor fan apparatus 15 and/or the control operations carried out with regard to the hot plates 14 and/or the extractor fan apparatus 15.

The scope of the control options of the mobile phone 19 and/or the cooking product sensor 20 with regard to the oven 3 comprises the temperature and/or the humidity within the cooking chamber 4, in particular the performance of the heating unit 12. Status information about the oven 3, which can be transmitted from the control device 6*a* to the mobile phone 19 and/or the cooking product sensor 20 via the wireless data connection 23, comprise the temperature and/or the humidity within the cooking chamber 4 and/or the performance of the heating unit 12.

The cooking product sensor 20 can be activated by means of the button 22*b*. In particular, the button 22*b* can be used to select and start a cooking program. The cooking product sensor 20 can transmit control commands for automated adjustment of the humidity and temperature in the cooking chamber 4 to the control device 6*a*. The mobile phone 19 can also transmit control commands to the respective control device 6*a*, 6*b* in an automated manner. For example, automated control can be performed in the course of processing a cooking recipe. The scope of control options for automated control of the cooking appliances 2, 3 by means of the mobile devices 19, 20 corresponds to the scope of control options for manual control.

Control of the hob system 2 can also be performed using the hob user interface 16. Preferably, user input via the user interface 5, 16 on the cooking appliance 2, 3 is prioritized with respect to control information from the mobile device 19, 20. Control information based on user input at the user interfaces 5, 16 of the cooking appliances 2, 3 is preferably transmitted to the mobile devices 19, 20 via the wireless data connection 23. The control information can be displayed on the screen 10*c*.

The above-described scope of control options of the cooking appliances 2, 3 by means of the mobile devices 19, 20 can be limited depending on the signal strength P of the wireless data connection 23. The signal strength P of the wireless data connection 23 between the respective control device 6*a*, 6*b* and the mobile device 19, 20 connected thereto varies in dependence on the respective distance $D_a$, $D_b$, $d_a$ between these devices and depending on individual influencing factors, such as objects located between these devices.

Figure 3:
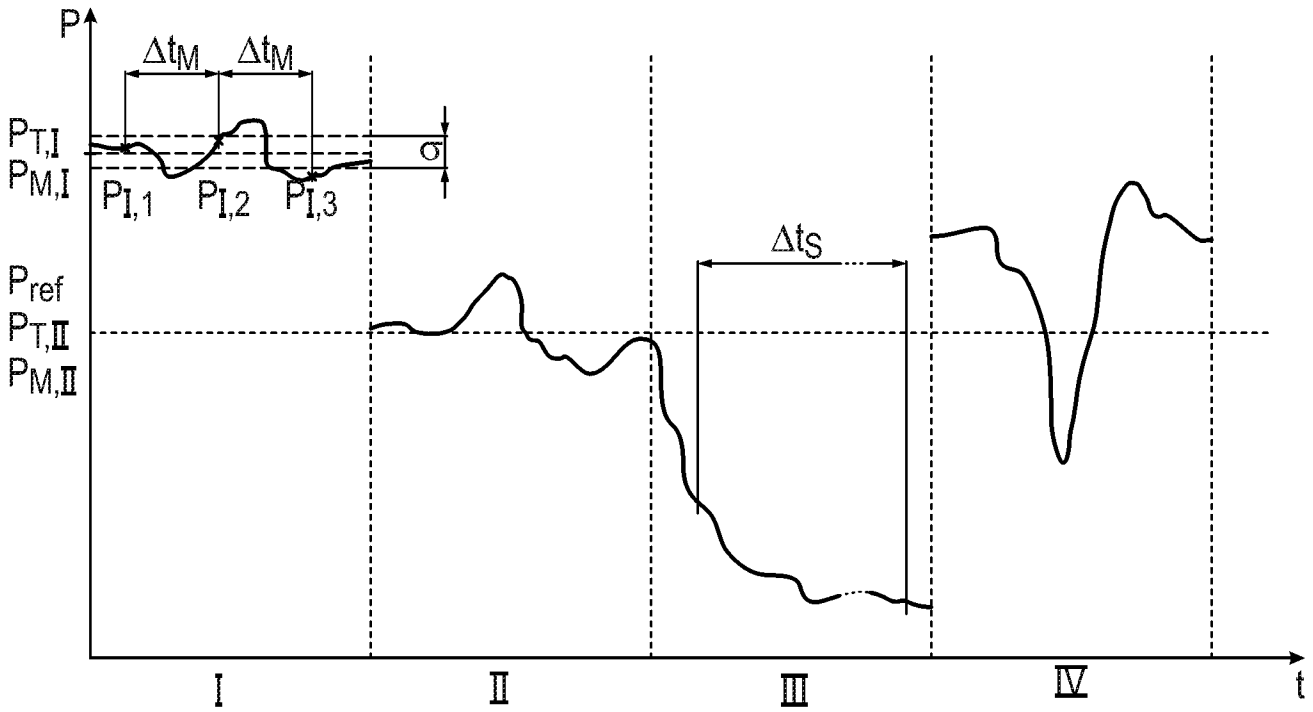
FIG. 3 shows four exemplary progressions I, II, III, IV of a signal strength of the wireless data connection between one of the control devices and the mobile device connected thereto in FIG. 1.

FIG. 3 shows an example of four curves of the signal strength P over the time t. The measured signal strength P is subject to fluctuations due to measurement tolerances and environmental influences. The first exemplary curve I of the signal strength $P_1$ is present when the mobile phone 19 is arranged in a close range of the control device 6*b*, in particular at a distance $D_{b,0}$=1 m. The second exemplary curve II of the signal strength P is present when the mobile phone 19 is arranged in a close range of the control device 6*b*. The second exemplary curve II of the signal strength $P_{II}$ is present at an average distance $D_{b,1}$=5 m. The third exemplary curve III of the signal strength $P_{III}$ is present at an increasing distance $D_b$ of the mobile phone 19 from the control device 6*b* from the average distance $D_{b,1}$ to the large distance $D_{b,2}$=10 m. The fourth exemplary curve IV of the signal strength $P_{IV}$ of the wireless data connection 23 between the mobile phone 19 and the control device 6*b* can be recorded at the average distance $D_{b,1}$, wherein the brief drop in the signal strength $P_{IV}$ is caused by a signal interference.

After the initial establishment of the wireless data connection 23 between the respective mobile device 19, 20 and the respective control device 6*a*, 6*b*, a reference test value $P_{ref}$ is determined. For this purpose, the hob user interface 16 indicates to the user that the mobile device 19 should be positioned at the average distance $D_{b,1}$ from the hob system 2, in particular from the control device 6*b*. The user arranges the mobile device 19, 20 accordingly and confirms this by making an entry on the hob user interface 16.

By means of the control device 6*b*, in particular the control radio module 27, n=3 sample values $P_i$, namely $P_{1,1}$, $P_{1,2}$, $P_{1,3}$, which correspond to an instantaneous signal strength P of the wireless connection 23, are successively detected within a sampling interval $\Delta t_M$=1 s. The calculation steps and/or comparison processes described below are carried out by means of the control device 6*b*, in particular the control processor unit 24. A sample average value $P_M$ is determined for the sample values $P_i$ according to the following formula:

$$P_M = \frac{\sum_{i=1}^{n}(P_i)}{n} \tag{1}$$

A test value $P_T$ is equated with the sampling average value $P_M$:$P_T$=$P_M$. The reference test value $P_{ref}$ can also be entered or changed manually via the user interface 5, 16 of the respective cooking appliance 2, 3. Preferably, the user input is limited by a minimum value for the reference test value Per for safety reasons.

The standard deviation σ of the sample values $P_i$ is determined according to the following formula:

$$\sigma = \sqrt{\frac{\sum_{i=1}^{n}(P_i - P_M)^2}{n}} \tag{2}$$

It is checked whether the standard deviation a is smaller than 10% of the test value $P_T$:

$$\sigma < 0{,}1 * P_T \tag{3}$$

If this criterion is fulfilled, the test value $P_T$ at the average distance $D_{b,1}$ is adopted as the reference value $P_{ref}$:$P_{ref}$=$P_T$. Otherwise, capturing and evaluating the sample values $P_i$ is repeated until the above test criterion is fulfilled and the reference value $P_{ref}$ can thus be determined.

During the existence of the wireless data connection 23, sample values $P_i$ are continuously determined within the interval $\Delta t_M$. The average sample value $P_M$ is determined for three consecutive sample values $P_i$ in each case. To determine a comparison result, the test value $P_T$ is compared with the reference test value $P_{ref}$. If $$P_T \geq P_{ref} \tag{4}$$

the controllability of the cooking appliance 2, 3 by means of the mobile device 19, 20 is not restricted. If, on the other hand, $$P_T < P_{ref} \tag{5}$$

and this comparison result is available without interruption for at least a switching period of $\Delta t_S$=5 s, the controllability of the cooking appliance 2, 3 by means of the mobile device 19, 20 is restricted. In other words, six successive test values $P_T$ must be below the reference test value $P_{ref}$ so that the controllability of the cooking appliance 2, 3 by means of the mobile device 19, 20 is limited. This prevents short-term signal gaps from leading to an undesired interruption of the wireless data connection 23. If the signal strength P and thus the test value $P_T$ rises again within the switching period $\Delta t_S$ so that the reference test value $P_{ref}$ is exceeded, the wireless data connection 23 is maintained.

If the test value $P_T$ reaches the reference test value $P_{ref}$, a warning tone is preferably emitted via a loudspeaker, which is not shown, of the mobile user interface 21*a* and a warning notice is displayed on the screen 10*c*. This informs the user that the scope of control will be limited after the switching period $\Delta t_S$ has elapsed if the corresponding mobile device 19, 20 is not arranged on the cooking appliance 2, 3 again in order to increase the received signal strength P.

In the wake of the third exemplary course III in FIG. 3, the controllability of the cooking appliance 2, 3 by means of the mobile device 19, 20 is restricted, since the test value $P_T$ is lower than the reference test value $P_{ref}$ over the switching period $\Delta t_S$. In the fourth exemplary course IV of the signal strength P, there is no restriction of the controllability of the cooking appliance 2, 3 by means of the mobile device 19, 20, since the test value $P_T$=$P_M$ is always above the reference test value $P_{ref}$.

If the controllability of the cooking appliance 2, 3 by means of the mobile device 19, 20 is limited, only the extractor fan apparatus 15 can be controlled. The control of the hob 13 and the oven 3 by means of the mobile device 19, 20 is blocked. This means that the respective control device 6*a*, 6*b* no longer converts control commands from the mobile devices 19, 20 into control signals for controlling the hob 13 or the oven 3. In addition, the mobile user interface 21*a*, in particular the screen 10*c*, is adapted such that user input is no longer possible for a corresponding control of the hob 13 and the oven 3. The scope of the status information transmitted via the wireless data connection 23 remains unchanged. At a signal strength P at which controllability is limited, status information continues to be transmitted to the mobile phone 19 and displayed on the screen 10*c*.

Figure 4:
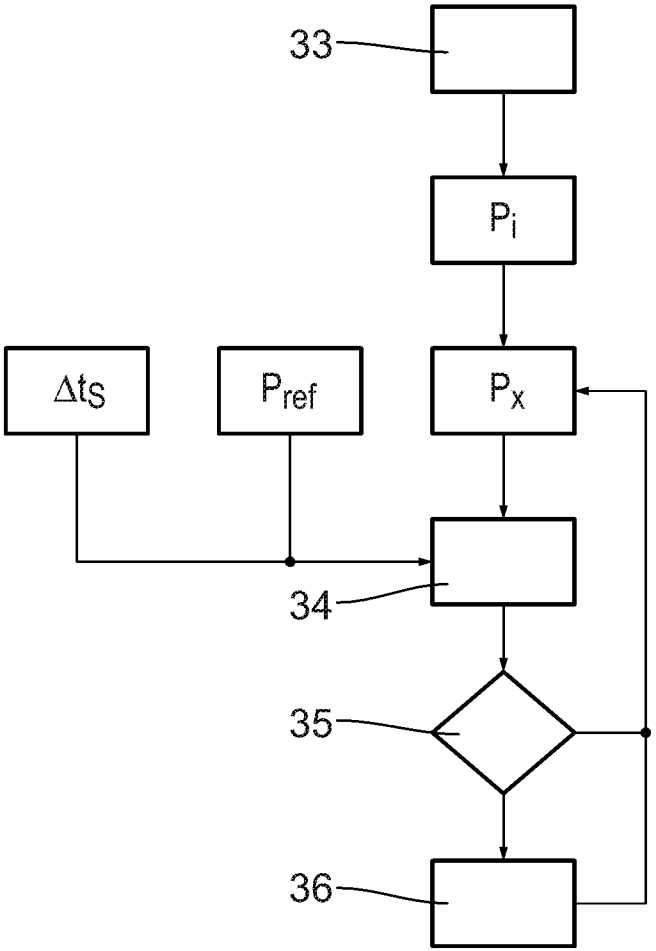
FIG. 4 shows a flowchart of a method for limiting the controllability of one of the cooking appliances by means of the associated mobile device based on a signal strength of the wireless data connection.
Figure 6:
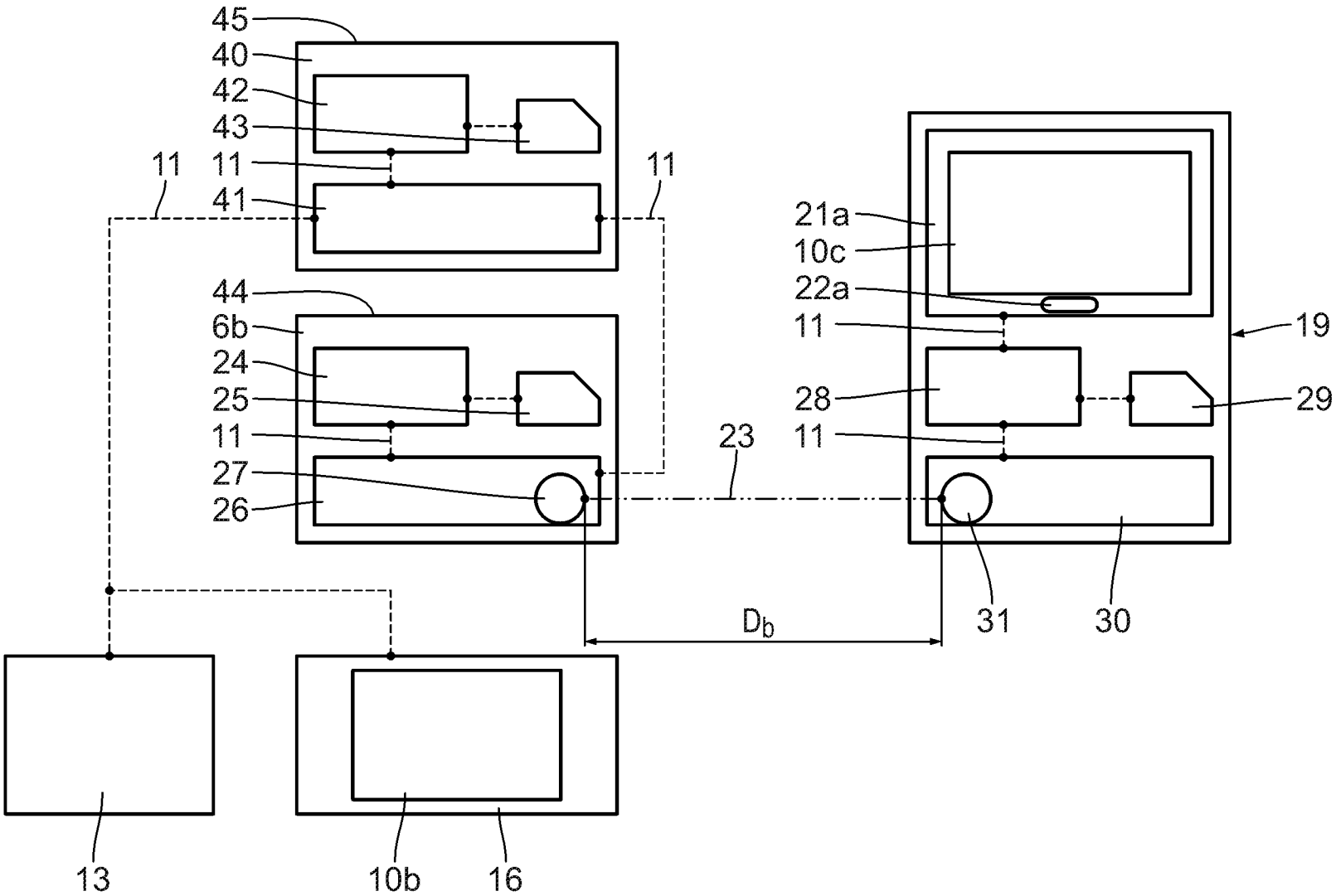
FIG. 6 shows an abstracted illustration of a cooking appliance system according to a further embodiment example, wherein a control device of the cooking appliance system is connected to the cooking appliance via a basic control device in a signal-transmitting manner.

FIG. 4 illustrates the method described above for determining the reference test value $P_{ref}$. Block 33 symbolizes the establishment of the wireless data connection 23 between the cooking appliance 2, 3 and the mobile device 19, 20. Block 34 symbolizes the comparison of the test value $P_T$ with the reference test value $P_{ref}$ and checking whether this comparison result is present without interruption at least over the switching period $\Delta t_S$. Block 35 symbolizes the decision based on the result from block 34. Block 36 symbolizes the restriction of the controllability of the cooking appliance 2, 3 by means of the mobile device 19, 20. The remaining blocks relate to the determination of the value indicated in the respective block.

Figure 5:
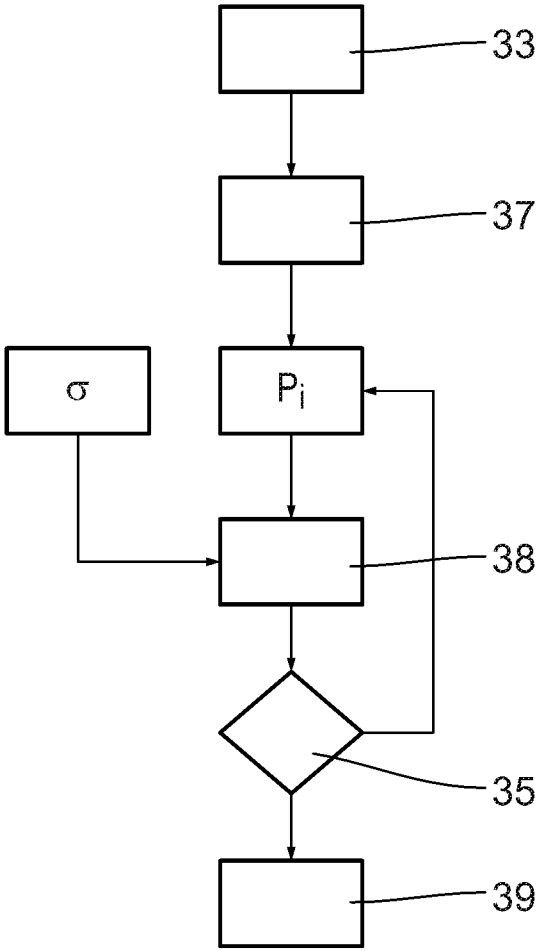
FIG. 5 shows a flowchart of a method for determining a reference test value based on a plurality of sample values that correlate to a signal strength of the wireless data connection.

FIG. 5 illustrates the method described above for limiting the controllability of the cooking appliance 2, 3 by means of the mobile device 19, 20. Block 37 symbolizes the arrangement of the mobile device 19, 20 at a distance $D_{b,1}$ from the cooking appliance 2, 3, in particular from the control device 6*a*, 6*b*. Block 38 symbolizes the test criterion relating to the standard deviation a for determining the reference test value $P_{ref}$. Block 39 symbolizes the determination of the reference test value $P_{ref}$ according to the sample average value $P_M$. The remaining blocks relate to the determination of the value indicated in the respective block.

The scope of control options of the respective cooking appliance 2, 3 by means of the respective mobile device 19, 20 can be extended to the unrestricted scope of control in an automated manner. The extension of the scope of controllability is carried out by the respective control device 6*a*, 6*b* if the following two test criteria are fulfilled. The test value $P_T$ must reach or exceed the reference test value $P_{ref}$:

$$P_T \geq P_{ref} \tag{6}$$

This increase in the test value $P_T$ must take place before a blocking period $\Delta t_R$=30 s has elapsed. If the test criterion is not fulfilled within the blocking period $\Delta t_R$, the scope of control can no longer be extended in an automated manner. Confirmation by the user at the oven user interface 5 or the hob user interface 16 is required to restore the unrestricted controllability of the respective cooking appliance 2, 3 by means of the respective mobile device 19, 20.

With reference to FIG. 5, a further embodiment example of the method for controlling a cooking appliance 2, 3, the computer program, the control device 6*a*, 6*b* or the cooking appliance system 1 is described. In contrast to the embodiment example described above, the control device 6*b* is connected to the hob 13 and the hob user interface 16 in a signal-transmitting manner via a basic control device 40. The basic control device 40 is designed to control the hob 13 on the basis of operator inputs via the user interface 16 and/or on the basis of control commands from the control device 6*b*. For data exchange with the control device 6*b*, the hob 13 and the hob user interface 16, the basic control device 40 comprises a basic communication unit 41. Furthermore, the basic control device 40 comprises a basic processor unit 42 for data processing and a basic memory unit 43 for storing data. The basic control device 40 is in signal connection with the hob 13, the hob user interface 16 and the control device 6*b* via a cable connection 11. The basic control device 40 preferably has a base housing 45 that is separate from a control housing 44 of the control device 6*b*.

The basic control device 40 is designed to control the hob 13 and the extractor fan apparatus 15, in particular independently of the control device 6*b*. The basic functions of the hob system 2 can thus be set independently of a mobile device 19, 20 and/or a control command from the control device 6*b*.

The control device 6*b* of the hob system 2 differs from the control device 6*a* of the oven 3 in that it is designed to exchange data with the basic control device 40, but not to directly control the cooking appliance 2, 3, in particular a heating unit 12, hot plates 14 and/or an extractor fan apparatus 15. The basic control device 40 differs from the control devices 6*a*, 6*b* in that it is designed without a control radio module 27 for establishing a wireless data connection 23 with a mobile device 19, 20.

According to one aspect of the invention, the control device 6*b* is designed as a retrofittable module. The basic control device 40 can be designed for retrofitting the control device 6*b* with a corresponding interface.

In contrast to the embodiment example described above, the hob system 2 is controlled by means of the mobile device 19 by means of the control device 6*b* via the basic control device 40. In accordance with the embodiment example described above, the control device 6*b* provides the signal for controlling the hob 13 via the cable connection 11 to the basic control device 40. The basic control device 40 provides a corresponding signal for controlling the hob system 2, at the hob 13, in particular the hot plates 14, and/or the extractor fan apparatus 15.

According to one aspect of the invention, the control commands received at the control device 6*a*, 6*b* and/or the basic control device 40 from the hob user interface 16 are given priority. This is understood to mean that when different control commands are received from the hob user interface 16 and the mobile device 19, in particular via the control device 6*a*, 6*b*, the control commands received from the hob user interface 16 are used to control the cooking appliance 2,3 and the control commands received from the mobile device 19 are ignored or suppressed.

In all other respects, the operating principle corresponds to the operating principle of the method described above, the computer program, the control device 6*a*, 6*b* or the appliance system 1.

The wireless data connection 23 between the respective cooking appliance 2, 3 ensures particularly flexible control by means of the respective mobile device 19, 20 and thus a high level of operating convenience. The control method is also particularly safe. In particular, it reliably prevents the respective cooking appliance 2, 3 from being controlled from outside the range that can be safely controlled by the user. By limiting the controllability of the cooking appliance 2, 3 on the basis of a plurality of sample values $P_i$, the control of the respective cooking appliance 2, 3 can be performed in a particularly robust and reliable manner.

The invention claimed is:

1. A method for controlling a cooking appliance on the basis of a control command transferred from a mobile device to a control device via a wireless data connection, comprising the steps of:

capturing a plurality of sample values correlating to a signal strength of the wireless data connection;

determining a single test value on the basis of the plurality of sample values;

comparing the test value with a reference test value to determine a comparison result; and limiting the controllability of the cooking appliance via the mobile appliance according to the comparison result, wherein determining the single test value comprises determining a sample average value of the plurality of sample values, wherein the reference test value is determined on the basis of a calibration test value, wherein the user is prompted by a user interface to position the mobile device at a preset distance from the control device and to confirm this arrangement via the user interface and wherein the calibration test value is determined as a test value at the preset distance between the control device and the mobile device.

2. The method according to claim 1, comprising determining a scatter value of the plurality of sample values from which the test value is determined.

3. The method according to claim 2, wherein the limitation of the controllability of the cooking appliance via the mobile device is carried out under a condition that the scatter value is lower than a reference scatter value.

4. The method according to claim 2, discarding the test value in dependence on the scatter value.

5. The method according to claim 1, wherein the determination of the reference test value is triggered by an initial establishment of the wireless data connection between the control device and the mobile device.

6. The method according to claim 1, comprising manually determining the reference test value according to a user input.

7. The method according to claim 1, comprising automatically extending the controllability of the cooking appliance via the mobile device in dependence on the comparison result.

8. The method according to claim 7, wherein an extension of the controllability of the cooking appliance via the mobile device is carried out automatically in dependence on a switching period over which the controllability of the cooking appliance was restricted, wherein the switching period over which the controllability was limited is a maximum of 60 s.

* * * * *